US006108816A

United States Patent [19]

Bradley

[11] Patent Number: 6,108,816

[45] Date of Patent: Aug. 29, 2000

[54] LOW PROFILE SURVIVAL VEST ENSEMBLE

[75] Inventor: Gary F. Bradley, Hendersonville, N.C.

[73] Assignee: Simula Inc., Phoenix, Ariz.

[21] Appl. No.: 09/169,471

[22] Filed: Oct. 9, 1998

Related U.S. Application Data

[60] Provisional application No. 60/062,145, Oct. 10, 1997.

[51] Int. Cl.[7] ..... A41D 1/02; B63C 9/08

[52] U.S. Cl. ..... 2/102; 2/94; 2/247; 182/3; 441/112

[58] Field of Search ..... 2/102, 94, 69, 2/86, 89, 92, 247, 249, 250, 251; 182/3, 4; 244/151 R; 441/106, 112, 114, 115, 117

[56] References Cited

U.S. PATENT DOCUMENTS

| | | | |
|---|---|---|---|
| 1,475,072 | 11/1923 | Langerman | 2/102 |
| 2,079,220 | 5/1937 | Mahoney . | |
| 2,823,396 | 2/1958 | Erickson . | |
| 2,950,488 | 8/1960 | Sabo . | |
| 3,105,359 | 10/1963 | Ellis . | |
| 3,570,030 | 3/1971 | Baker . | |
| 3,672,609 | 6/1972 | Hawkins . | |
| 4,388,734 | 6/1983 | Cowden . | |
| 4,578,042 | 3/1986 | Evert . | |
| 5,014,359 | 5/1991 | Hanson | 2/94 |
| 5,220,976 | 6/1993 | Gunter | 182/3 |
| 5,465,425 | 11/1995 | Crispin . | |
| 5,544,363 | 8/1996 | McCue et al. | 2/102 |
| 5,641,247 | 6/1997 | Seligman . | |
| 5,673,836 | 10/1997 | Bush | 224/576 |
| 5,799,329 | 9/1998 | Hauschild | 2/102 |
| 5,913,409 | 6/1999 | Test | 2/102 |

*Primary Examiner*—John J. Calvert
*Assistant Examiner*—Tejash Patel
*Attorney, Agent, or Firm*—Shaw Pittman

[57] ABSTRACT

A survival vest having a broad central strip forming the stem of a "Y" covering the back of the wearer, with left and right front strips (forming the twin forks of the "Y") dividing from the stem of the "Y" at the back of the neck and running down along each of the front shoulder/armpit areas of the wearer. The tips of each fork of the "Y" expand to form large, pockets which cover the front of the chest, abdomen, and (partially) the sides of the wearer. The twin large pockets are formed using a heavy-duty zipper, sewn around the periphery of each pocket area and are completely detachable. A webbing harness reinforces the vest across the inside of the twin pockets and along the forks of the "Y"-shape of the vest, from the base of the pockets to the point at which they join to form the collar of the vest, and along the outer edges of the stem of the "Y" which forms the back of the vest. A number of hook-and-loop fasteners (such as Velcro®) in the form of strips or patches are used to attach the survival pouches. The loop portion of the fasteners are sewn into the inner surface of each large pocket area (next to the wearers body), and the hook portion of the fasteners are sewn into the back surface of the smaller survival equipment pouches.

35 Claims, 8 Drawing Sheets

LOW PROFILE SURVIVAL VEST ENSEMBLE

This application claims the benefit of Provisional Ser. No. 60/062,145 filed Oct. 10, 1997.

BACKGROUND

1. Field of the Invention

The present invention relates generally to protective garments for use in emergencies and, more particularly, to a reinforced nylon mesh vest or other garment capable of carrying numerous items of survival equipment.

2. Background of the Invention

Current military survival vests for aircrews include numerous, variable-sized pockets for holding rescue or survival equipment. These pockets are usually sewn or otherwise mounted onto the outer surface of the primary vest material, with certain adjustments in the placement of the pockets made to accommodate male or female anatomy. Despite these adjustments, however, the bulk and orientation of the pockets and their contents tends to affect crew mobility and comfort. Due to the fact that the equipment pockets are permanently attached, the wearer also has few options for rearranging the disposition of survival or rescue equipment on or within the vest.

SUMMARY OF THE INVENTION

The present invention is intended for use primarily by military aircrew and passengers for all missions which require issue of a survival vest as personal flight equipment. Such missions may involve fixed-wing or rotary-wing aircraft, including ejection seat-equipped aircraft, cargo and/or personnel transport aircraft, or patrol/reconnaissance aircraft.

The present invention is constructed of an essentially unitary heavy-weight nylon mesh vest or other garment tailored into three primary sections, described in detail below. To this basic structure, additional features are attached or incorporated so as to facilitate the carrying of survival equipment within the vest, to permit the user to adjust the vest for maximum comfort, and to enhance the user's chances for survival and rescue.

The overall shape of the vest is shown in FIG. 1. It may be best described as a "Y" form, with a broad central strip forming the stem of the "Y" covering the back of the wearer, and with left and right front strips forming the twin forks of the "Y" dividing from the stem of the "Y" at the back of the neck and running down along each of the front shoulder/armpit areas of the wearer, and the tips of each fork of the "Y" expanded to form the inner walls of the large twin pocket areas which cover the front of the chest, abdomen, and (partially) the sides of the wearer. A heavy-duty zipper 16 may be used to join the front portions of each pocket area, and close the vest across the chest of the wearer.

The vest has a broad central strip 10 of heavy-weight nylon mesh material that forms the stem of the "Y". It is designed to cover an area from the collar and upper shoulders of the wearer to the center of the lower back just above the waist or belt line of the wearer. A separate, single layer of heavy-weight nylon mesh is attached to each of the expanded tips of the left and right forks of the "Y" using heavy-duty zippers 15 to form the outer wall of each large pockets area 12. The zippers are sewn around the entire periphery of each pocket area as shown in FIG. 2, allowing the user to completely detach and re-attach the outer wall of the pocket. Thus the user may interchangeably attach different pocket configurations depending on the intended use of the survival vest. For example, if the user must alternate between forest and desert conditions, only one vest is needed, with different pocket outer walls configured to provide the appropriate camouflage. If the user requires easy access to line cutters, as in the case of personnel using parachutes, a pocket designed for that purpose could be used. In another example, if the user requires quick access to a weapon a pocket designed to holster a handgun could be attached. Additionally, the outer wall forming the pockets may be used with other garments, such as a flight-jacket, flight-suit or hunting jacket equipped with compatible large pocket areas and zippers.

A nylon webbing harness 11 reinforces the nylon mesh of the vest itself across the inside of the twin pockets and along the forks 22 of the "Y"-shape of the vest, from the base of the pockets to the point at which they join to form the collar of the vest, and along the outer edges of the stem of the "Y" which forms the back of the vest. Also, a number of adjustable nylon webbing straps 13 are used to join the back portion of the vest to the rear-facing edges of each of the twin pockets. A variety of individual, detachable, re-sealable pouches 19 of different sizes and shapes within the two large vest pockets can be used to store survival equipment such as a flashlight, radio beacon, flares, radio transmitter/receiver, holster and firearm, water supply, medical supplies, and other similar emergency supplies.

A number of hook-and-loop fasteners (such as Velcro®) in the form of strips or patches 20 are used to attach the survival pouches. The loop portion of the fasteners are sewn into the inner surfaces of each large pocket, and the hook portion of the fasteners are sewn into the back surface of the smaller survival equipment pouches. Adjustable buckles 14, as necessary to the harness configuration, permit the user to adjust those harness straps joining the back portion 10 of the vest (stem of the "Y") to the pockets 12 of the vest (tips of each fork of the "Y"), to achieve maximum comfort.

An additional component of the present invention is a pair of nylon webbing leg loops 24 and a pair of lift loops 23 incorporated into the harness webbing as shown in FIG. 8. These twin leg loops and the lift loops enable the wearer to be air-rescued by hoist with no additional equipment. The twin leg loops are removable and may be stowed in the pockets or pouches of the vest.

The present invention also features two pairs of grommets and one pair of nylon webbing loops integrated into the harness and located at either side of the neck opening and in parallel arrangement along the webbing at either side of the chest front opening. These fixtures are designed to permit attachment to the vest of a flotation collar, such as the Safety Equipment, Inc. (SEI) Low Profile Flotation Collar (U.S. Pat. No. 5,692,933, which is incorporated herein by reference).

DETAILED DESCRIPTION OF THE INVENTION

Figure 1:
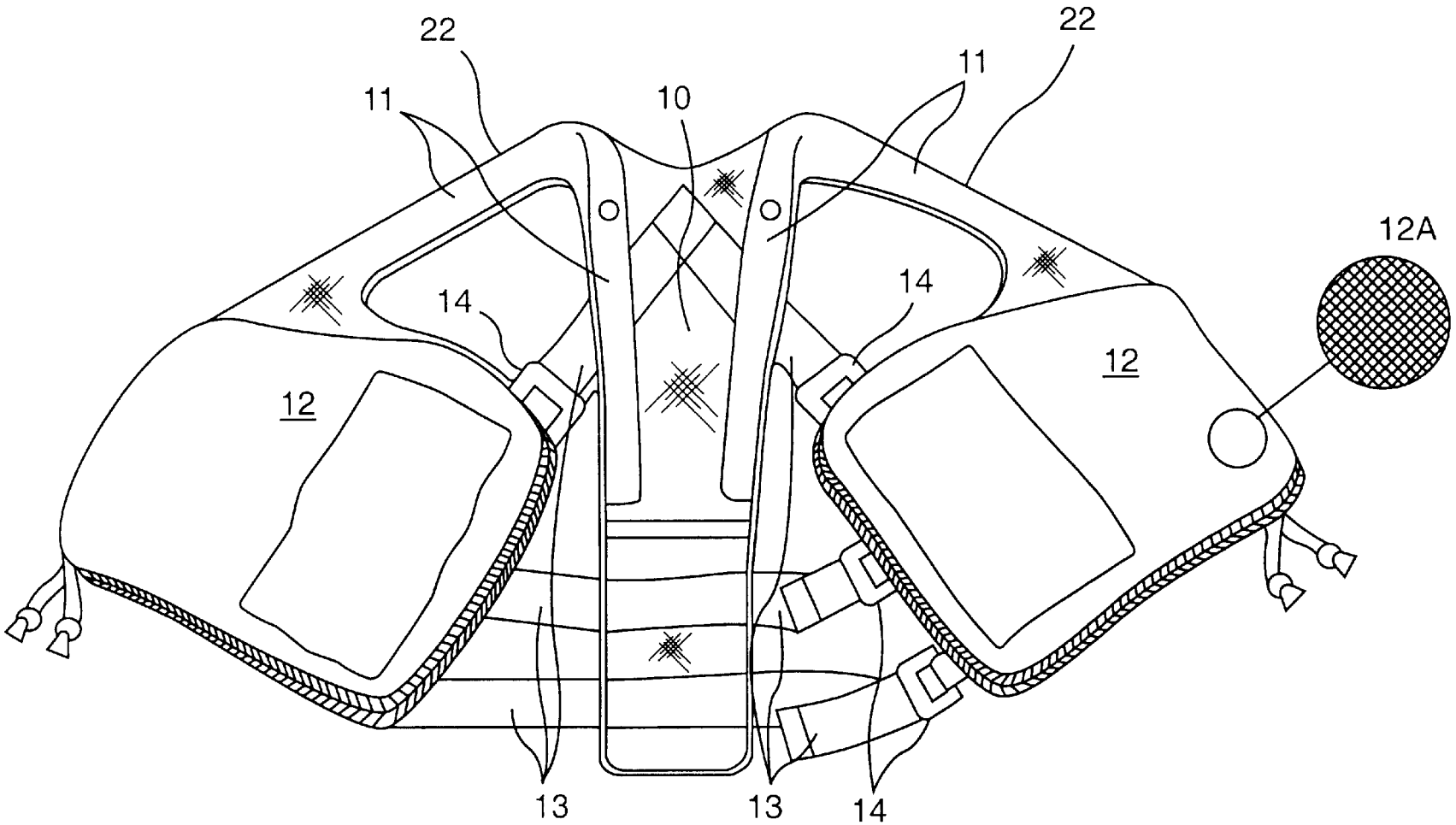
FIG. 1 is a schematic diagram of the invention illustrating the "Y" configuration and the large pocket.

FIG. 1 is a schematic diagram of the invention showing the rear-facing areas of the above-described "Y" configuration of the vest, with the back portion 10 (or stem of the "Y") tapering into the shoulder/armpit portions 11 (or forks of the "Y"), and then expanding to form the inner walls of twin large pocket areas 12 (or tips of the "Y"). The circular area 12A is intended to represent the approximate texture and density of weave of the nylon mesh that is used to form the four halves of the twin pockets 12. Also depicted are the nylon webbing straps 13 and buckles 14 that the user may adjust to achieve optimal fit and comfort.

Figure 2:
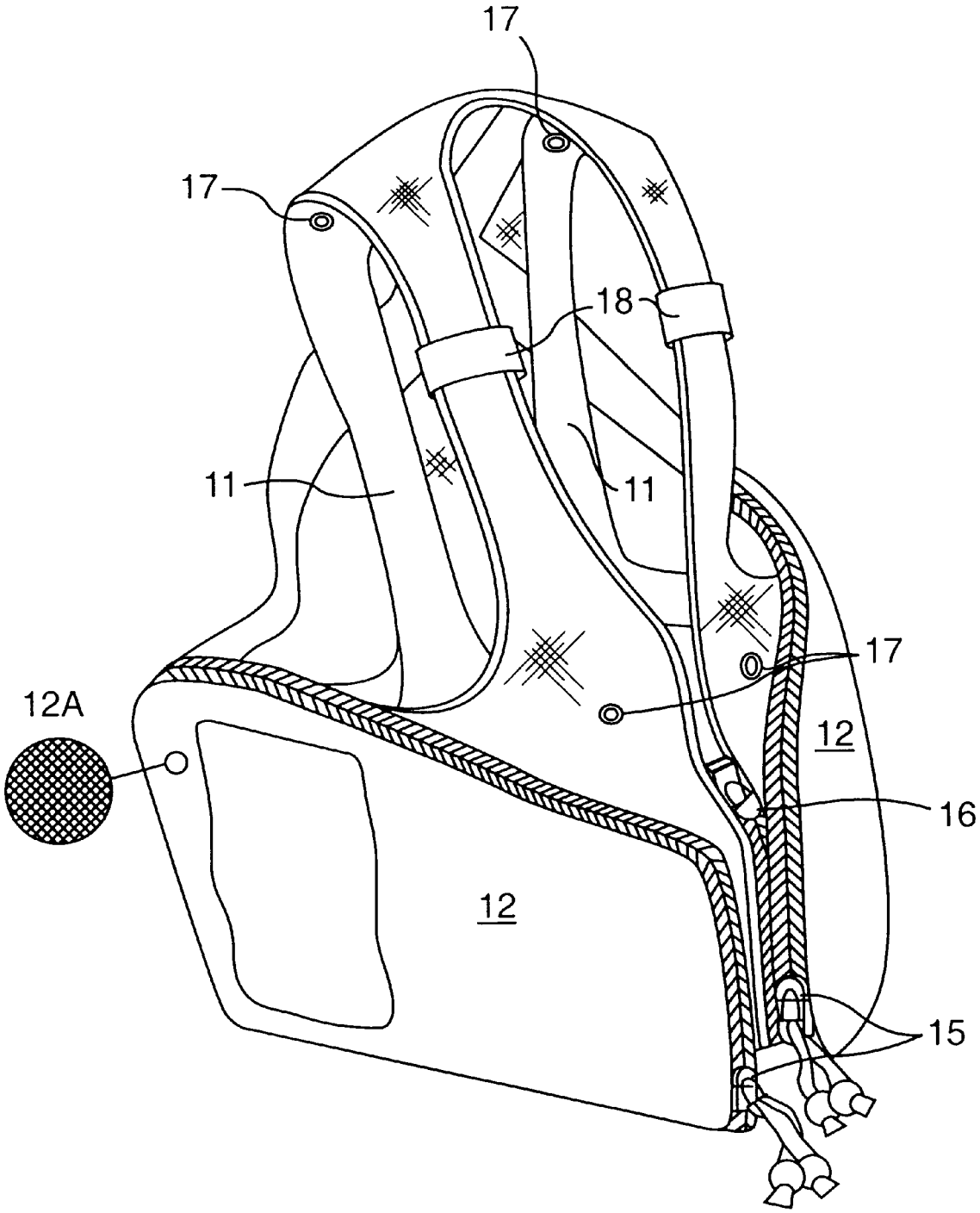
FIG. 2 is a schematic diagram showing the right front quarter of the present invention as it would appear on the wearer, with both large pockets zippered closed.

FIG. 2 is a schematic diagram of the right front quarter of the present invention as it would appear on the wearer, with both large pockets 12 zippered closed. Matching heavy-duty zippers 15 are sewn along the entire periphery of each pocket area, enabling the user to implement multiple pocket configurations for the survival vest. A single heavy-duty zipper 16 runs along the leading edge between the twin large pockets 12, enabling the user to close the vest across the front of the chest. The four grommet holes 17 and twin nylon strap loops 18 enable attachment of the flotation collar, described above.

Figure 3:
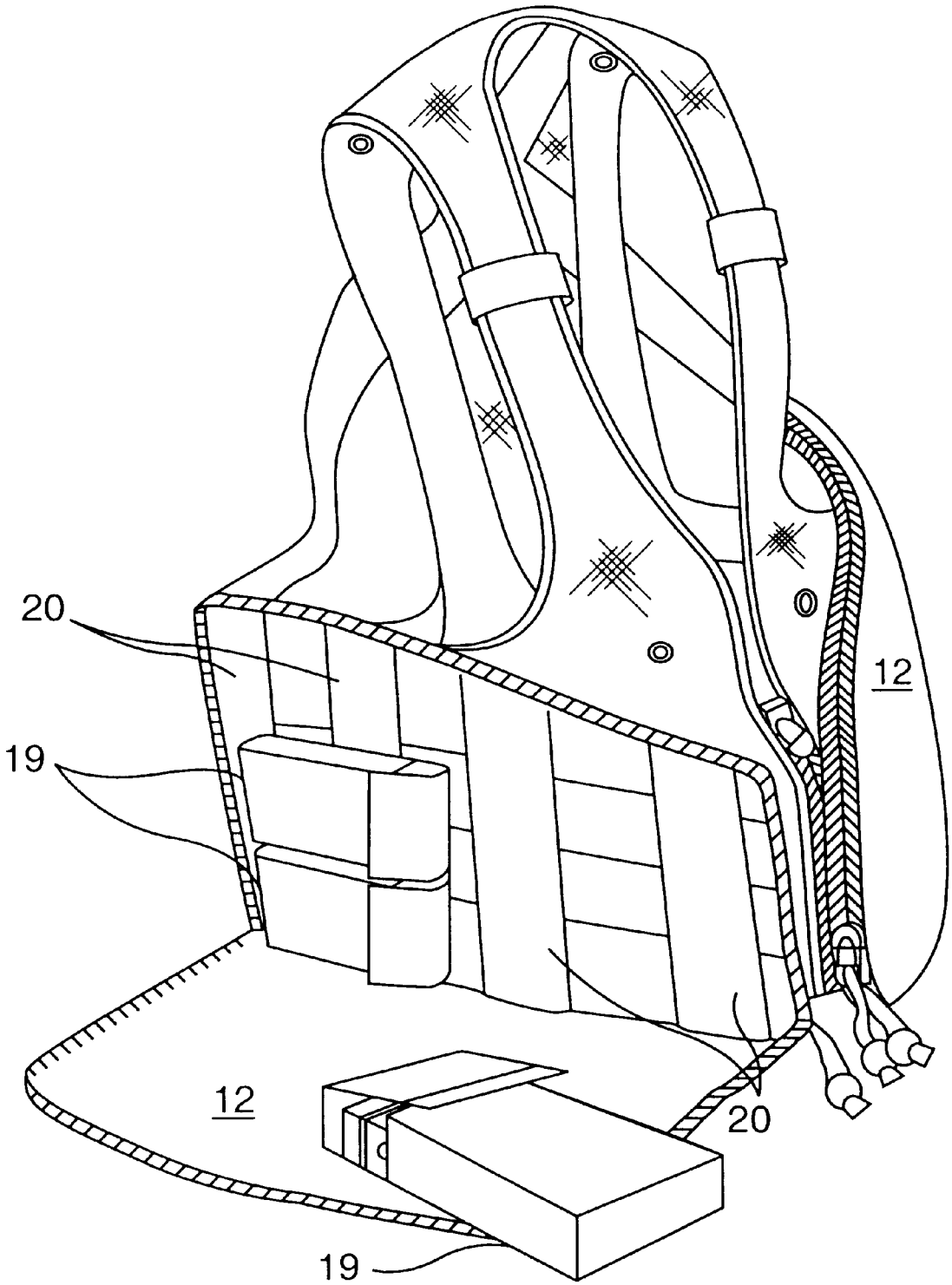
FIG. 3 is a schematic diagram of the right front quarter of the present invention as it would appear on the wearer, with the right large pocket area unzipped, revealing a possible configuration of smaller, removable pouches.

FIG. 3 is a schematic diagram of the right front quarter of the present invention as it would appear on the wearer. FIG. 3 shows the right large pocket area 12 unzipped, revealing a possible configuration of smaller, removable pouches or pockets 19. Pockets 19 are designed to be secured to the interior of the large pocket area 12 by means, in this embodiment, of strips of hook-and-loop fastener material 20.

Figure 4:
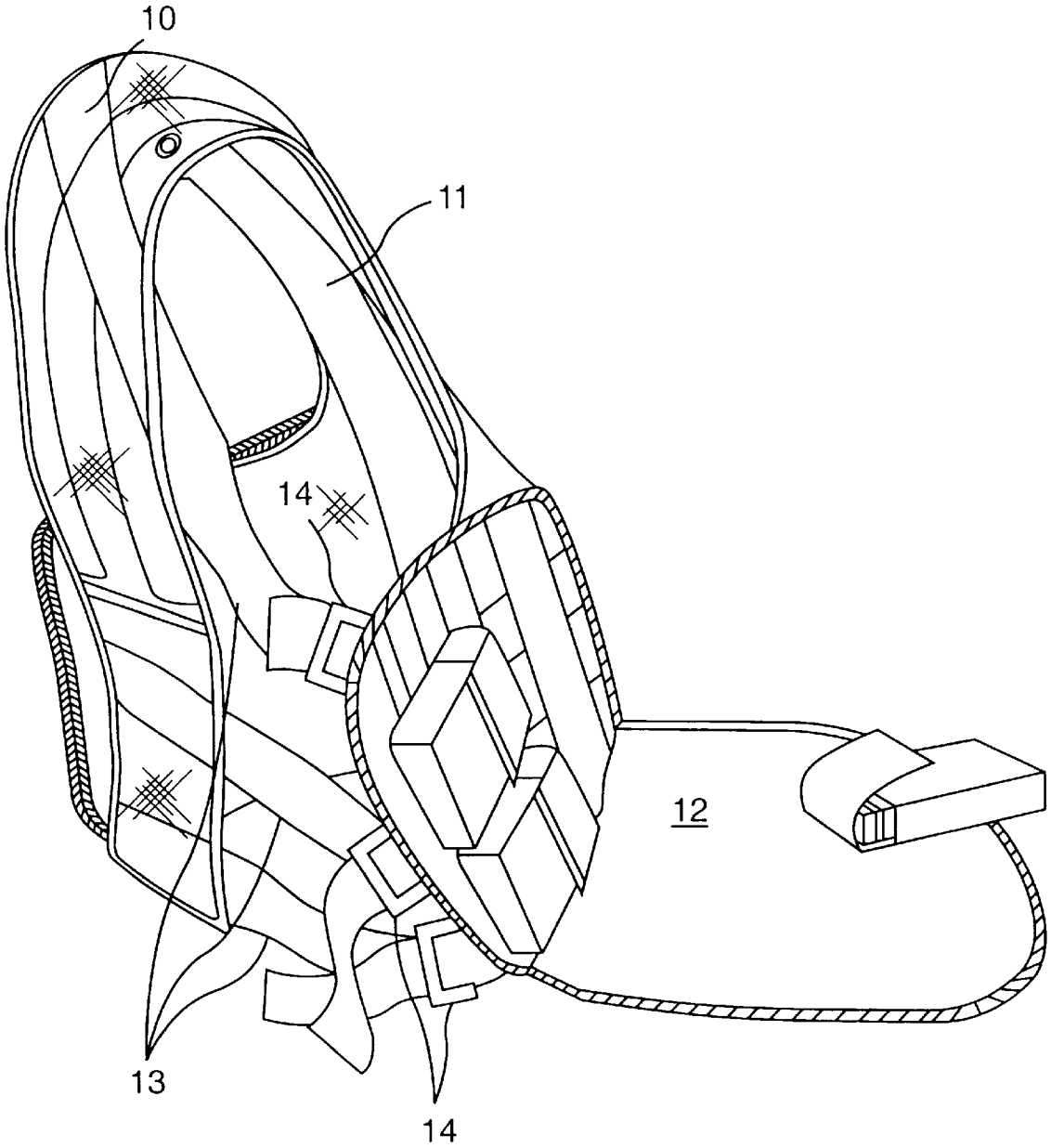
FIG. 4 is a schematic diagram of the right side of the invention as it would appear on the wearer, with the right large pocket area unzipped.

FIG. 4 is a schematic diagram of the right side of the invention as it would appear on the wearer, with the right large pocket area 12 unzipped. Also shown are the nylon webbing straps 13 and buckles 14 that the user may adjust to achieve optimal fit and comfort, and the section of nylon mesh 10 that covers the back of the wearer.

Figure 5:
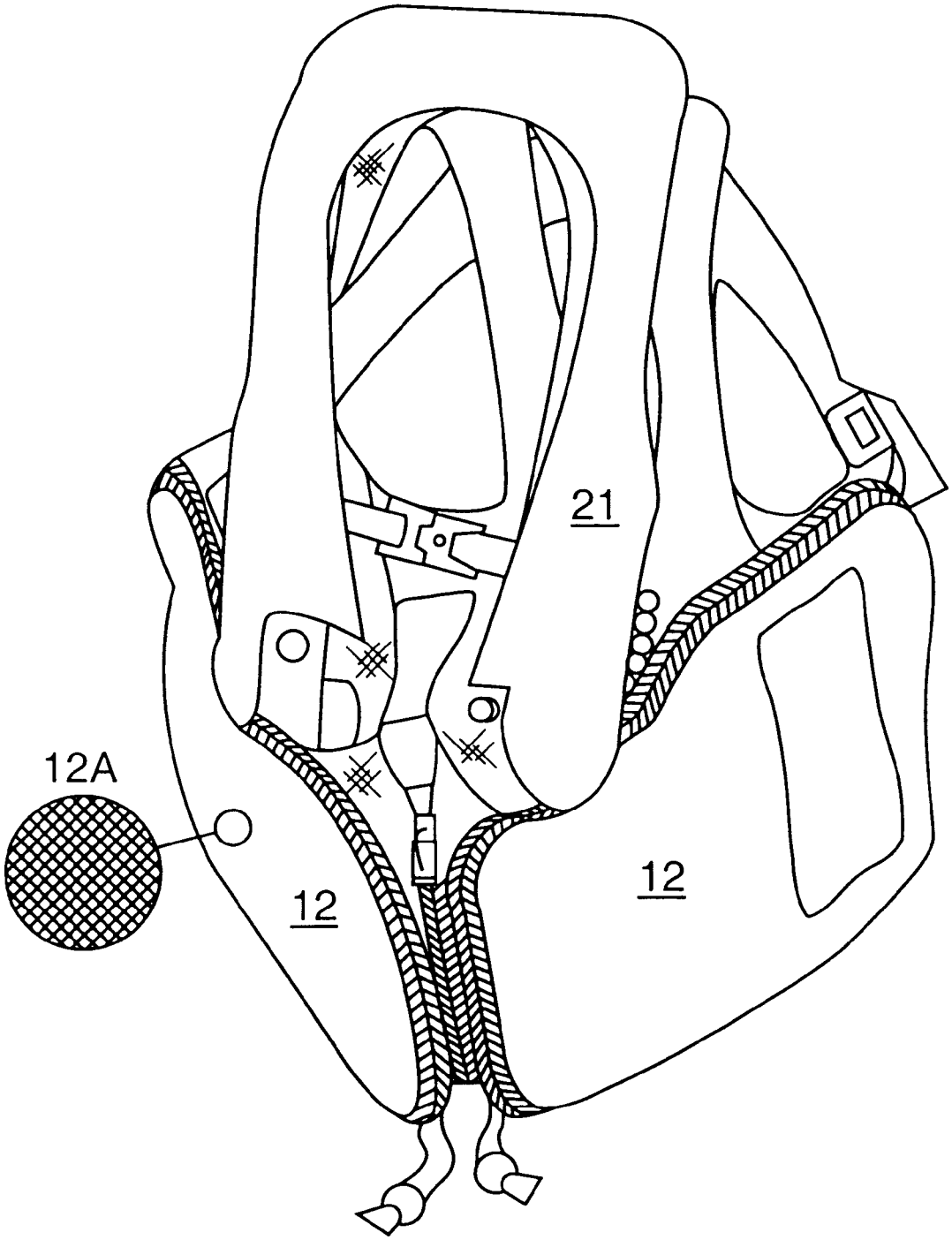
FIG. 5 is a schematic diagram of a frontal view of the invention with the flotation collar attached, and with the large pockets zippered closed.

FIG. 5 is a schematic diagram of a frontal view of the present invention with flotation collar 21 attached, and the large pockets 12 zippered closed. The circular area 12A is intended to represent the approximate texture and density of weave of the nylon mesh that is used to form the four halves of the twin pockets 12.

Figure 6:
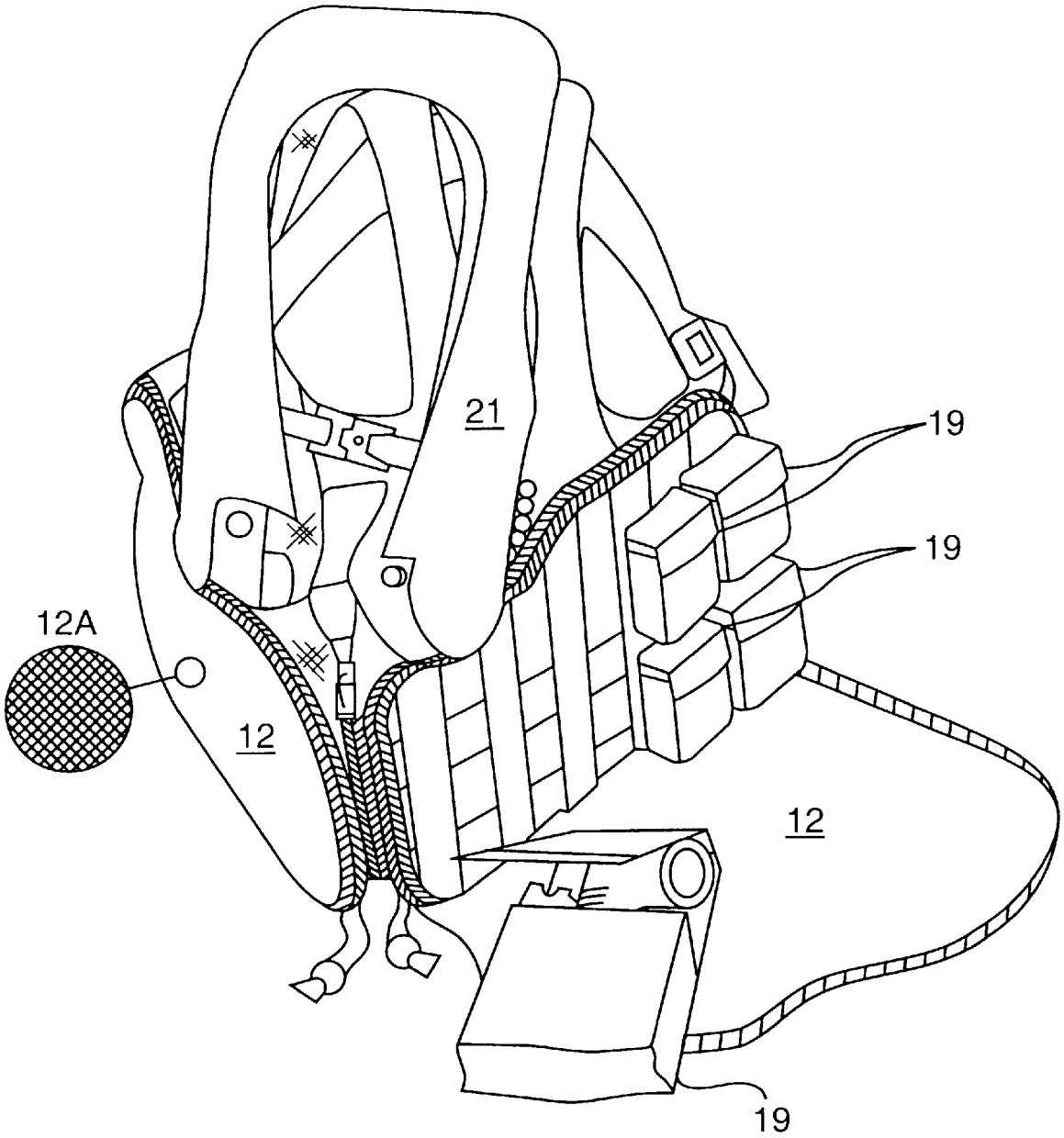
FIG. 6 is a schematic diagram of a frontal view of the invention with the flotation collar attached, and the left large pocket area zippered open, revealing a possible configuration of smaller, removable pouches.

FIG. 6 is a schematic diagram of a frontal view of the present invention with flotation collar 21 attached, and left large pocket area 12 zippered open, revealing a possible configuration of smaller, removable pouches or pockets 19. Again, the circular area 12A is intended to represent the approximate texture and density of weave of the nylon mesh that is used to form the four halves of the twin pockets 12.

Figure 7:
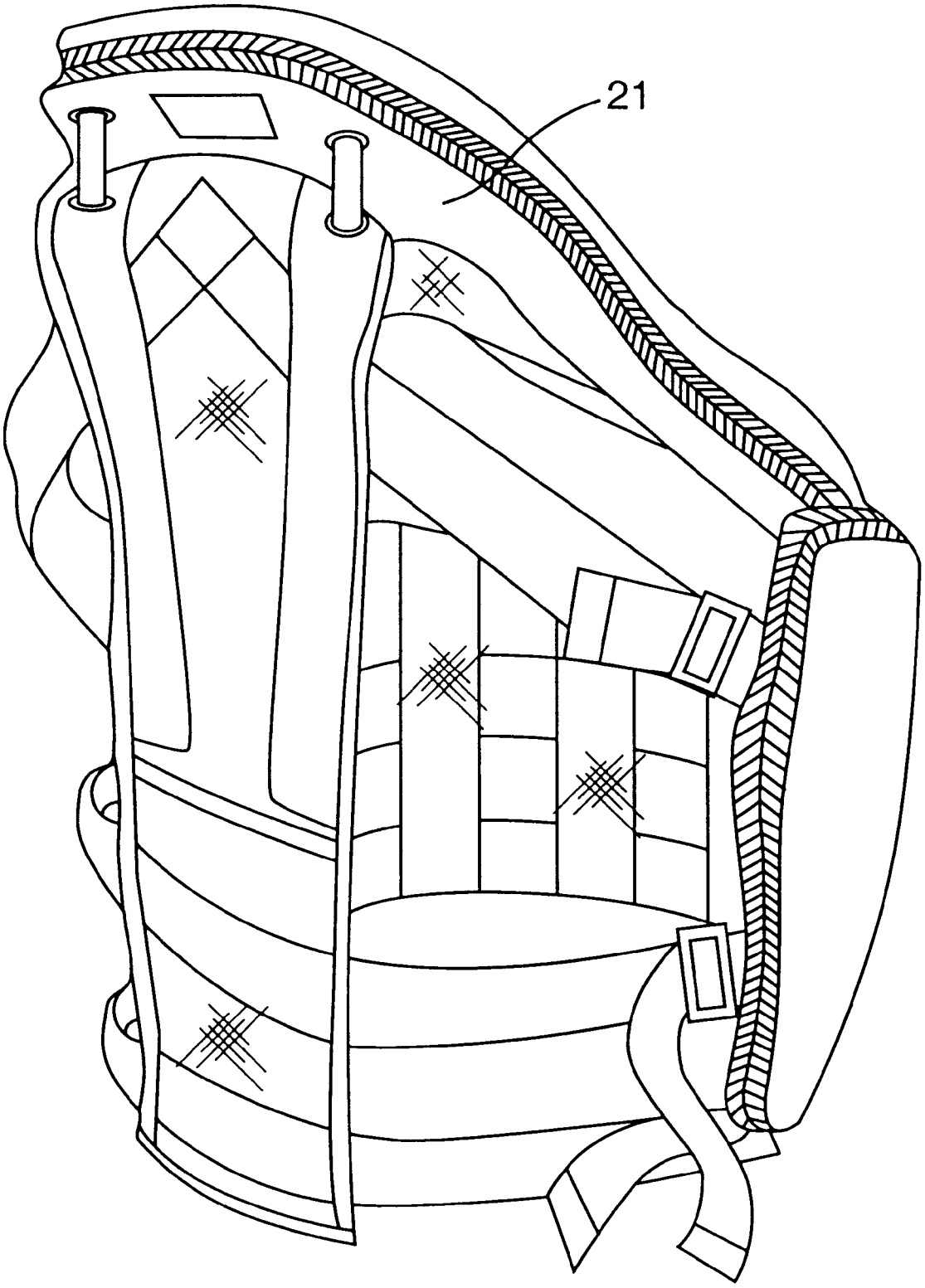
FIG. 7 is a view of the right side of the invention with a flotation collar attached.
Figure 8:
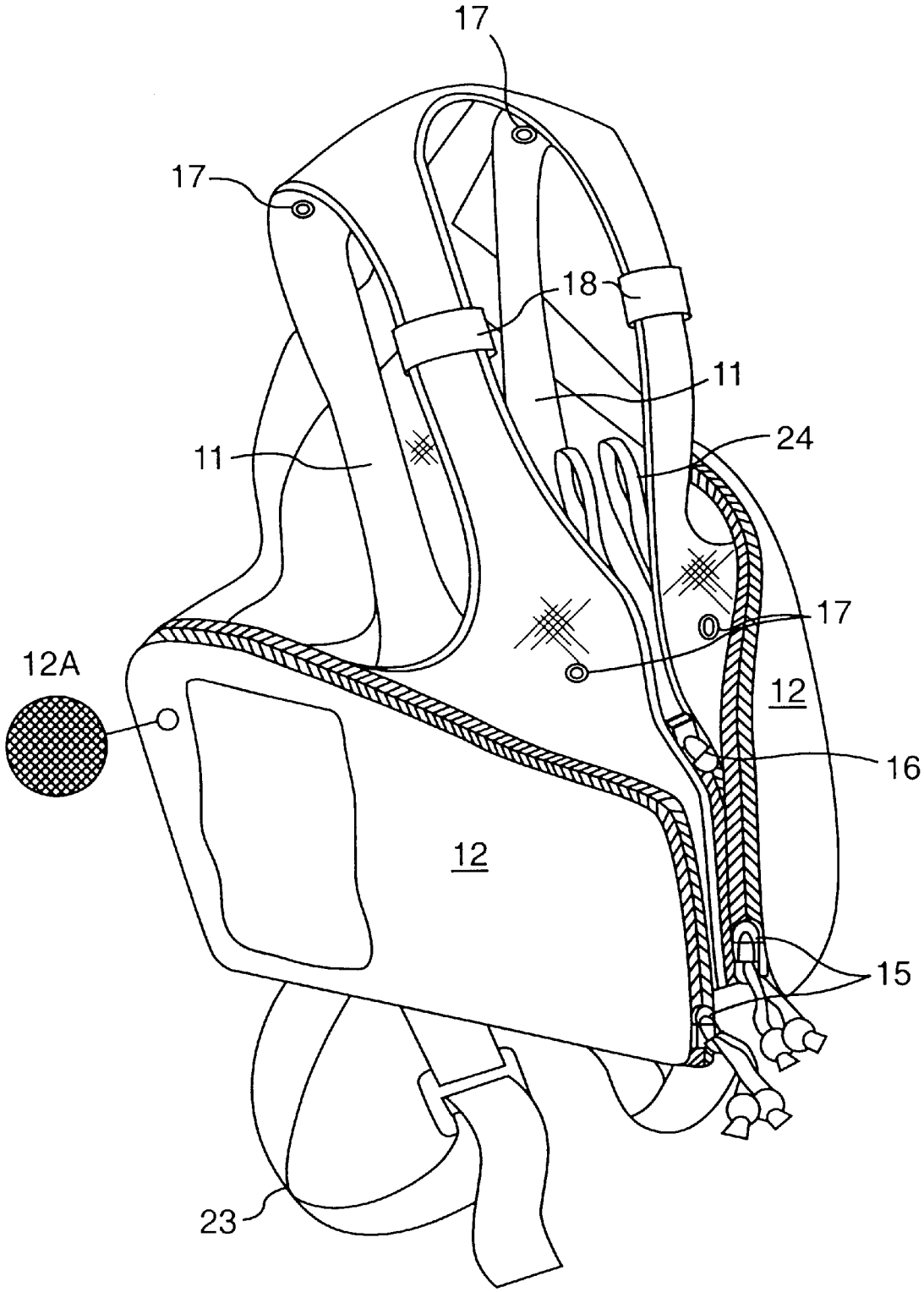
FIG. 8 is a schematic diagram of the right front quarter of the present invention illustrating the twin nylon leg loops and lift loops used for air-rescue.

FIG. 7 is a schematic diagram of the right side of the present invention with the flotation collar 21 attached. FIG. 8 is a schematic diagram of the right front quarter illustrating the twin nylon leg loops 23 and lift loops 24 used for air-rescue. The modularity and ease of detaching and reattaching the flotation collar, leg loops and lift loops limits the necessity for extraneous gear.

The present invention is smaller, lighter, and less bulky than the survival vests currently supplied to members of the U.S. military. The present invention is also smaller, lighter, and less bulky than vests or other garments used for hiking, boating or other such activities requiring the user to safely and conveniently carry a variety of smaller items without restricting mobility. It has none of the protruding pockets of the vest models or garments now in use, which tend to inhibit range of motion for the user and lead to wearer discomfort. The vest is easily adjustable to accommodate all user body shapes and sizes required by U.S. military garment specifications. The individual wearer has a large number of options available for determining how the items of survival equipment he or she wishes to carry should be arranged within the vest for optimal comfort and convenience.

The open weave of the nylon mesh material allows air to pass through easily, so the vest is more comfortable in high temperature or high humidity environments. The vest meets U.S. military wind blast protection requirements (it will withstand a dynamic pressure of 9 psi, as experienced during the first 300 msec of ejection from an aircraft traveling at 600 KEA). Furthermore, in comparison with survival vests now used in the U.S. military, the wearer experiences far less "bounce" of equipment while he or she is running.

The vest is designed to accommodate the flotation collar, so no additional flotation devices are required. The absence of flotation bladders, compressed gas canisters, or other flotation equipment or devices within the vest itself means there is more room to carry survival gear. The vest can easily accommodate body-mounted chemical, biological, and radiological breathing and filtering components by changing the configuration of the outer wall of the pocket. Finally, the fact that nylon webbing lift loops are integrated into the vest design itself means that air-rescue personnel do not have to employ an additional sling or harness to lift the wearer to safety. Access to and engagement of the loops to a rescue hoist can be accomplished with the SEI Flotation Collar deflated or fully deployed.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

What is claimed is:

1. A survival vest comprising:

(a) a broad central strip dimensioned to extend from a wearer's central lower back up to the wearer's neck, said central strip forming the stem of a "Y" configuration;

(b) a left front strip and a right front strip forming the forks of the "Y" configuration, said left and right front strips configured to divide from the wearer's neck down the wearer's left and right sides, respectively;

(c) a left and a right removable area, said pocket areas each comprising a unitary material having a zipper around a periphery of the unitary material for removably attaching the left and right pocket areas to the left and right front strips, respectively;

(d) a means for securely attaching a flotation collar to the vest; and (e) a webbing harness attached to and reinforcing the central strip, the front strips and the left and right pockets.

2. The survival vest of claim 1, wherein the central strip, the front strips and the pockets are constructed from a unitary mesh material.

3. The survival vest of claim 1, wherein the central strip, the front strips and the pockets are constructed from heavy-weight nylon mesh material.

4. The survival vest of claim 1, further comprising a means for securely attaching air-rescue hoisting equipment to the vest.

5. The survival vest of claim 4, wherein the a means for securely attaching air-rescue hoisting equipment to the vest comprises at least one loop attached to the webbing harness.

6. The survival vest of claim 5, wherein the at least one loop is detachable and re-attachable.

7. The survival vest of claim 5, wherein the at least one loop is constructed of nylon webbing material.

8. The survival vest of claim 1, further comprising a plurality of grommets incorporated into the webbing harness.

9. The survival vest of claim 1, further comprising a plurality of loops attached to the webbing harness.

10. The survival vest of claim 1, further comprising at least one adjustable webbing strap attached to the central strip adjustably joining the central strip to the pockets.

11. The survival vest of claim 1, further comprising a means for securely attaching survival pouches to the inner surfaces of the pockets.

12. The survival vest of claim 11, further comprising a first portion of hook-and-loop fasteners attached to the inner surfaces of the pockets.

13. The survival vest of claim 12, further comprising survival pouches having the second portion of hook-and-loop fasteners attached to a surface of the survival pouches.

14. The survival vest of claim 13, further comprising a first portion of hook-and-loop fasteners attached to the inner surface of the outer wall of the pocket.

15. The survival vest of claim 1, further comprising a means for securely attaching the front left and right strips along the leading edges.

16. The survival vest of claim 15, further comprising a zipper attached to the leading edges of each strip.

17. The survival vest of claim 15, further comprising a first portion of hook-and-loop fasteners attached to the leading edge of the left front strip.

18. The survival vest of claim 17, further comprising a second portion of hook-and-loop fasteners attached to the leading edge of the right front strip.

19. A survival vest comprising:

(a) broad central strip dimensioned to extend from a wearer's central lower back up to the wearer's neck, said central strip forming the stem of a "Y" configuration;

(b) a left front strip and a right front strip forming the forks of the "Y" configuration, said left and right front strips configured to divide from the wearer's neck down the wearer's left and right sides, respectively;

(c) at least one large pocket area comprising a unitary material having a zipper around a periphery of the unitary material for removably attaching the at least one large pocket area to at least one of the front strips;

(d) a means for securely attaching a flotation collar to the vest; and (e) a webbing harness attached to and reinforcing the central strip, the front strips and the at least one pocket.

20. The survival vest of claim 19, wherein the central strip, and the front strips are constructed from a unitary mesh material.

21. The survival vest of claim 19, further comprising a means for securely attaching air-rescue hoisting equipment to the vest.

22. The survival vest of claim 19, further comprising at least one adjustable webbing strap attached to the central strip adjustably joining the central strip to the pockets.

23. The survival vest of claim 19, further comprising a first portion of hook-and-loop fasteners attached to the inner surfaces of the pockets.

24. The survival vest of claim 23, further comprising a plurality of survival pouches having a second portion of hook and loop fasteners attached to a surface of the plurality of survival pouches.

25. A survival vest comprising:

(a) broad central strip dimensioned to extend from a wearer's central lower back to the wearer's neck, said central strip forming the stem of a "Y" configuration;

(b) a left front strip and a right front strip forming the forks of the "Y" configuration, said left and right front strips configured to divide from the wearer's neck and to run down the front of the wearer on the left and right sides, respectively;

(c) a means for securely attaching a left unitary material and a right unitary material forming a left pocket area and a right pocket area on the left and right front strips, respectively;

(d) a webbing harness attached to and reinforcing the central strip, the front strips and the left and right pockets; and (e) at least one survival pouch.

26. The survival vest of claim 25, wherein the central strip and the front strips are constructed from a unitary mesh material.

27. The survival vest of claim 25, further comprising a means for securely attaching air-rescue hoisting equipment to the vest.

28. The survival vest of claim 25, further comprising a means for securely attaching a flotation collar to the vest.

29. The survival vest of claim 25, wherein the means for securely attaching left-and right unitary materials comprises a zipper.

30. The survival vest of claim 25, wherein the means for securely attaching left and right unitary materials comprises a first portion of hook-and-loop fasteners attached to a periphery of the left-and right unitary materials.

31. The survival vest of claim 30, wherein the means for securely attaching left and right unitary materials further comprises a second portion of hook-and-loop fasteners attached to the left and right front strips of the survival vest.

32. The survival vest of claim 25, further comprising at least one adjustable webbing strap attached to the central strip adjustably joining the central strip to the pockets.

33. The survival vest of claim 25, further comprising a first portion of hook-and-loop fasteners attached to an inner surface of the pocket areas.

34. The survival vest of claim 33, further comprising a second portion of hook-and-loop fasteners attached to an outer surface of the at least one survival pouch.

35. The survival vest of claim 34, wherein the at least one survival pouch is capable of being fully enclosed in one of the pocket areas.

* * * * *